US005645930A

United States Patent [19]

Tsou

[11] Patent Number: 5,645,930

[45] Date of Patent: Jul. 8, 1997

[54] DURABLE ELECTRODE COATINGS

[75] Inventor: Yu-Min Tsou, Lake Jackson, Tex.

[73] Assignee: The Dow Chemical Company, Midland, Mich.

[21] Appl. No.: 513,581

[22] Filed: Aug. 11, 1995

[51] Int. Cl.[6] ..... B32B 5/16; C25B 11/04

[52] U.S. Cl. ..... 428/328; 204/280; 204/290 R; 204/290 F; 204/292; 428/341; 428/699; 428/701; 428/702; 428/704; 428/908.8

[58] Field of Search ..... 428/341, 323, 428/328, 699, 702, 701, 704, 908.8; 429/27, 29, 40, 41, 42, 44, 46; 204/280, 290 R, 290 F, 292

[56] References Cited

U.S. PATENT DOCUMENTS

| | | | |
|---|---|---|---|
| 4,061,802 | 12/1977 | Costello | 427/304 |
| 4,402,996 | 9/1983 | Gauger et al. | 427/86 |
| 4,459,324 | 7/1984 | Gauger et al. | 427/86 |
| 4,541,905 | 9/1985 | Kuwana et al. | 204/38.7 |
| 4,552,857 | 11/1985 | Katz et al. | 502/101 |
| 4,668,370 | 5/1987 | Pellegri | 204/252 |
| 4,764,401 | 8/1988 | Sirinyan et al. | 427/304 |
| 4,798,662 | 1/1989 | Clerc-Renaud et al. | 204/290 R |
| 4,976,831 | 12/1990 | Murrer et al. | 204/98 |
| 5,035,789 | 7/1991 | Beaver et al. | 204/290 R |
| 5,066,380 | 11/1991 | Byrd et al. | 204/290 R |
| 5,153,023 | 10/1992 | Orlowski et al. | 427/555 |
| 5,171,644 | 12/1992 | Tsou et al. | 429/12 |
| 5,203,978 | 4/1993 | Tsou et al. | 204/252 |
| 5,227,030 | 7/1993 | Beaver et al. | 204/98 |
| 5,314,760 | 5/1994 | Tsou et al. | 429/12 |
| 5,336,384 | 8/1994 | Tsou et al. | 204/252 |
| 5,503,663 | 4/1996 | Tsou | 106/1.24 |

OTHER PUBLICATIONS

J. Electrochem. Society, vol. 139 NO. 12, Dec. 1992, pp. 3475–3480.

J. Electrochem. Society, vol. 137 NO. 1, Jan. 1990, pp. 95–101.

*Primary Examiner*—H. Thi Le

[57] ABSTRACT

Durable electrolytic cell electrodes having low hydrogen overpotential and performance stability. A highly porous electrocatalytic primary phase and an outer, secondary phase reinforcement coating are provided on an electrically conducting transition metal substrate to make the electrodes. Durability is achieved by the application of the outer secondary phase to protect the primary phase electrocatalytically active coating. A process is also disclosed for catalizing a substrate surface to promote electroless deposition of a metal.

6 Claims, 2 Drawing Sheets

DURABLE ELECTRODE COATINGS

BACKGROUND OF THE INVENTION

1. Field of the Invention

This invention is directed to electrocatalytic electrodes, particularly cathodes useful in electrolysis cells such as a chlor-alkali cell and methods for preparing these cathodes and a method of activating a substrate prior to electroless deposition of a metal.

2. Description of Related Prior Art

The importance of efficient and durable electrodes for use in chlor-alkali membrane or diaphragm electrolytic cells is readily apparent when it is considered that millions of tons of chlorine and caustic soda are produced every year, mainly by electrolysis of aqueous solutions of sodium chloride.

The most widely used chlor-alkali processes employ either diaphragm or membrane type cells. In a diaphragm cell, an alkali metal halide brine solution is fed into an anolyte compartment where halide ions are oxidized to produce halogen gas. Alkali metal ions migrate into a catholyte compartment through a hydraulically-permeable microporous diaphragm disposed between the anolyte compartment and the catholyte compartment. Hydrogen gas and aqueous alkali metal hydroxide solutions are produced at the cathode. Due to the hydraulically-permeable diaphragm, brine may flow into the catholyte compartment and mix with the alkali metal hydroxide solution. A membrane cell functions similarly to a diaphragm cell, except that the diaphragm is replaced by an hydraulically-impermeable, cation selective membrane which selectively permits passage of hydrated alkali metal ions to the catholyte compartment. A membrane cell produces aqueous alkali metal hydroxide solutions essentially uncontaminated with brine.

Electrolytic cells fail to realize the degree of efficiency which can be theoretically calculated by the use of thermodynamic data. Production at the theoretical voltage is not attainable and a higher voltage, i.e., a so-called overvoltage, must be applied to overcome various inherent resistances within the cell. Reduction in the amount of applied overvoltage leads to a significant savings of energy costs associated with cell operation. A reduction of even as little as 0.05 volts in the applied overvoltage translates to significant energy savings when processing multimillion-ton quantities of brine. As a result, it is desirable to discover methods which will minimize overvoltage requirements.

It is known that the overpotential for an electrode is a function of its chemical characteristics and current density. See, W. J. Moore, *Physical Chemistry*, pp. 406–408 (Prentice Hall, 3rd ed. 1962). Current density is defined as the current applied per unit of actual surface area on an electrode. Techniques which increase the actual surface area of an electrode, such as acid etching or sandblasting the surface of the electrode, result in a corresponding decrease of the current density for a given amount of applied current. Inasmuch as the overpotential and current density are directly related to each other, a decrease in current density yields a corresponding decrease in the overpotential. The chemical characteristics of materials used to fabricate the electrode also impact overpotential. For example, electrodes incorporating an electrocatalyst accelerate kinetics for electrochemical reactions occurring at the surface of the electrode.

Various methods designed to reduce the overvoltage requirements of an electrolytic cell have been proposed including decreasing the overpotential requirements of the electrodes relating to their surface characteristics. In addition to the physical characteristics of the surface of the electrode, the chemical characteristics of the surface of the electrode can be selected to reduce the overpotential of the electrode. For instance, roughening the surface of the electrode decreases overpotential requirements. The platinum group metals are particularly useful to reduce overpotential requirements when present as the metal, alloys, oxides or as mixtures thereof on the surface of an electrode.

Electrodes are usually prepared by providing an electrocatalytic coating on a conducting substrate. The platinum group metals, such as ruthenium, rhodium, osmium, iridium, palladium, and platinum are useful electrocatalyst. For example, in U.S. Pat. No. 4,668,370 and U.S. Pat. No. 4,798,662 there are disclosed electrodes useful as cathodes in an electrolytic cell. These are prepared by coating an electrically conducting substrate such as nickel with a catalytic coating comprising one or more platinum group metals from a solution comprising a platinum group metal salt. Both of these patents disclose electrodes designed to reduce the operating voltage of an electrolytic cell by reducing the overpotential requirements of the electrode. U.S. Pat. No. 4,668,370 also discloses means to overcome the poor adhesion of platinum group metal oxides to non-valve metals when the platinum group metal oxides are coated by electrodeposition from a plating bath. In addition, U.S. Pat. No. 5,035,789, U.S. Pat. No. 5,227,030, and U.S. Pat. No. 5,066,380 disclose cathode coatings which exhibit low hydrogen overvoltage potentials. Metallic surfaced substrates utilized as electrode bases can be selected from nickel, iron, steel, etc. These non-valve metal substrates are disclosed as effectively coated utilizing a non-electrolytic reduction deposition method in which a water soluble platinum group metal salt alone or in combination with a platinum group metal oxide in particulate form is deposited from an aqueous coating solution having a pH of less than about 2.8.

A desirable characteristic of a cathode coating is high porosity with large internal surface areas. Large internal surface areas result in lower effective current density and, accordingly, lower overpotentials. Another result of a porous electrode is higher resistance to impurity poisoning. Rough outer surfaces of a typical porous electrode render difficult the electrodeposition of metal ions as impurities and the large internal electroactive surface areas are not easily accessible to the impurity ions present in the electrolyte because of long pathways for diffusion.

Raney nickel is an example of a porous electrode. In use, Raney nickel porous cathode coatings consisting of non-noble metals such as Raney nickel or Raney cobalt show reduced performance characteristics after shut down of an electrolytic cell. The reduced performance is apparently caused by the oxidation of the nickel or cobalt to the hydroxide during the electrolytic cell shut down period.

Zero-gap electrolytic cells have recently found acceptance industrially. In these cells, both the anode and the cathode are placed in contact with the cell membrane. This configuration avoids the overvoltage problems associated with electrolyte resistance in the older gap cells in which there is a space between the electrode and the membrane. Cathode coatings on thin substrates allow very close contact between an electrode and a membrane without damage to the cell membrane. Because of the thin electrode substrate and because of the requirement that the coating remain adhered to the electrode substrate while exposed to a cell membrane over a large membrane surface, the adhesion of the coating to the electrode substrate must be very tenacious to avoid loss of coating during operation of the electrolytic cell.

It has been found that a durable, porous electrode can be effectively prepared by utilizing a two step method in which two coating layers are applied, each coating layer interpenetrating the adjacent coating layer.

Also disclosed herein is a method of applying an electroless metal coating solution to plate a metal on a non-conductive substrate.

As disclosed in U.S. Pat. No. 4,061,802 and U.S. Pat. No. 4,764,401 palladium chloride has been used to activate plastic or metal substrates prior to nickel plating by electroless deposition. Jackson discloses a water soluble palladium sulfate/polyacrylic acid catalyst system for copper plating of printed circuit boards in J. Electrochemical Society 137, 95 (1990).

In U.S. Pat. No. 4,764,401, organometallic palladium compounds are disclosed as useful to activate a plastic substrate prior to electroless plating of a metal thereon. The palladium compounds are applied to the plastic surface to activate the surface so that an improved rate of electroless plating can take place. The prior art use of organometallic compounds of palladium has the disadvantage that such small molecules tend to be absorbed unevenly on the plastic surface. In addition, subsequent to application of the organometallic compounds of palladium from a solvent solution, crystallization of the molecules can occur. This can cause segregation of the catalyst and leave areas of the plastic surface uncovered by the organometallic palladium compound activator. Such segregation of the palladium activator can also cause growth in the size of the activator molecules and loss in coverage on the plastic surface area. The use of an amorphous polymer instead of the organometallic compounds of palladium overcome these problems simply because an amorphous polymer forms a relatively uniform film on the plastic substrate. Ligands on the amorphous polymer chain can be used to bind the palladium compound and distribute them evenly over the surface of the plastic substrate.

The use of water soluble amorphous polymers, such as polyacrylic acid, as disclosed by Jackson, cited above, in order to incorporate a palladium compound as an activator compound on a plastic substrate also results in difficulty. Such polymer coatings tend to release from the plastic surface carrying the palladium compound activator with it. When this occurs, a plating reaction in the plating solution is initiated. This is undesirable as it results in loss of activity of the bulk solution and can cause inferior coatings on the plastic substrate.

Accordingly, a water insoluble polymer rather than a water soluble polymer is superior as a carrier for the activating palladium compound prior to plating on a plastic surface.

SUMMARY OF THE INVENTION

Figure 1:
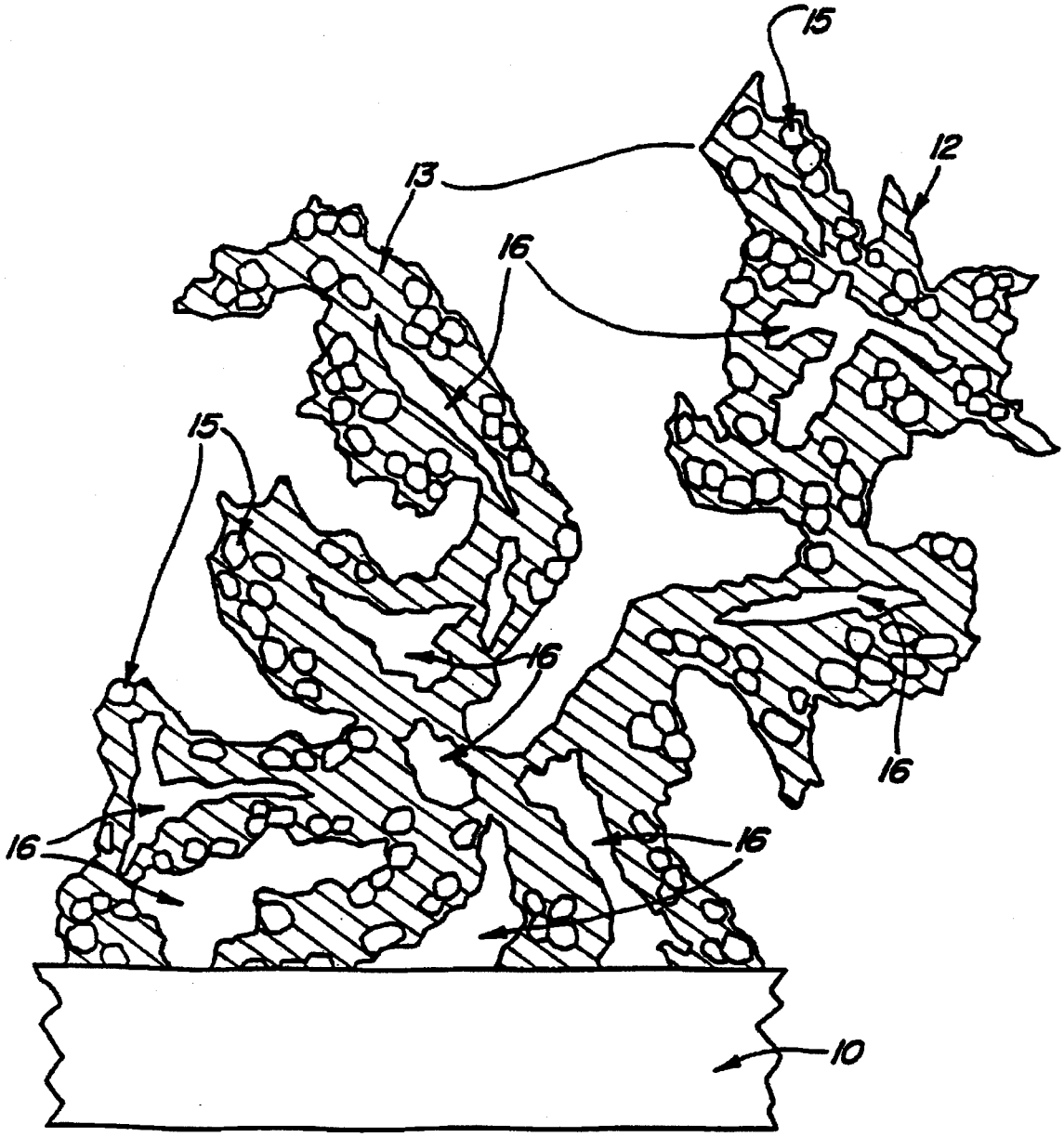
FIG. 1 is an approximately 3000 times magnified representation of a cross section through a substrate coated with the primary phase cathode coating of the invention.

Cathode coatings of the invention on an electrically conducting substrate suitable for use in an electrolytic cell have a coating comprising two interpenetrating, multi-component phases. The first phase, which is applied directly on the substrate, is composed of an electrocatalytic metal or an electrocatalytic metal alloy, in admixture with a particulate material, preferably, an electrocatalytic metal oxide. In the first phase, designated hereafter as the primary phase, the electrocatalytic metal coating is applied as a highly porous adherent matrix layer comprising at least one primary electrocatalytic metal and agglomerated particles of a particulate material, preferably, at least one electrocatalytic metal oxide, together with the oxides of the electrically conducting substrate or an optional secondary electrocatalytic transition metal oxide. In the second phase of the cathode coating of the invention which is applied over the first phase coating and is designated hereafter as the reinforcement phase, the metal components can be non-electrocatalytic. The reinforcement phase is present not only on the outer surface of the primary phase coating but also can be present on the boundaries of large pores formed within the first porous phase, or primary phase. In addition, the reinforcement phase can be present on any interstitial areas between the electrically conducting substrate and the primary phase. In effect, the two phases can be considered to be interpenetrating because, while the reinforcement phase is applied over the primary phase, the reinforcement phase covers porous areas and interstitial areas which can be under or within the pores of the primary phase porous, dendritic coating. The reinforcement phase is characterized by a bilayer structure in which an intermediate layer consists, generally, of a platinum group metal preferably, of palladium metal and an organic, water insoluble polymer. In the outer layer of the reinforcement phase, a transition metal or a transition metal alloy is present.

In the method of the invention for the preparation of the electrocatalytic coatings of the invention two important steps must be accomplished:

1) A porous, electrocatalytic phase, the multi-component, i.e., a platinum group metal component and a platinum group metal oxide component primary phase is applied to an electrically conducting substrate so as to produce a porous, dendritic, heterogeneous coating having a substantial internal surface area.

2) Thereafter, a bilayer reinforcement phase is applied so as to interpenetrate the primary phase coating.

The porous, electrocatalytic, primary phase coating is applied by conventional methods, such as by thermal spraying or by electroplating, preferably, with suspended electrocatalytic metal oxide powders present in the electroplating solution, or the primary phase can be applied by non-electrolytic reductive deposition or electroless deposition with the preferred electrocatalytic metal oxide powders suspended in the deposition solution. In the non-electrolytic deposition method, the electrically conducting substrate can act as the reductant. In this method, the electrically conducting substrate is placed in contact with a coating solution containing a solvent and the primary electrocatalytic metal ions together with particles of at least one primary electrocatalytic metal oxide. The electrically conducting substrate is allowed to remain in contact with the coating solution under conditions and for a time sufficient to deposit on the electrically conductive substrate a porous layer which is composed of agglomerates of the electrocatalytic metal oxide in the electrocatalytic metal matrix. During the formation of the coating by non-electrolytic reductive deposition, a small amount of the electrically conducting substrate is dissolved and metal ions of the metal of the substrate are entrapped in the metal and metal oxide agglomerates forming the coating on the electrically conducting substrate. Optionally, the coating can be baked in air in order to convert the metals in the coating to the corresponding metal oxides.

In a second step of the coating process of the invention, the cathode coating composed of agglomerates of the preferred electrocatalytic metal oxide in the electrocatalytic metal matrix together with metal oxides derived from the electrically conducting substrate are subjected to an electroless plating step in which the plated metal is a transition metal or a phosphorous or boron alloy, preferably, nickel or cobalt, nickel phosphide or boride or cobalt phosphide or boride. In this plating step, the second phase coating interpenetrates the first phase coating. This phase forms on the outer surface of the first primary phase coating and also around pores or voids which exist in the primary phase coating. Interstitial areas at the boundary of the primary phase and the electrically conducting substrates are also coated in this metal plating step. Generally, a transition metal is used in the reinforcement phase coating and as an electrode substrate.

In order to achieve a consistent, uniform firmly adherent, electroless metal/phosphorous alloy, plating layer on all exposed internal and external surfaces of the primary electrocatalytic metal first phase coating layer, an intermediate coating is applied prior to the application of a reinforcement phase coating. The intermediate coating of a water insoluble polymer having nitrogen ligands which bind metal facilitates the consistently adherent and uniform electroless plating of the reinforcement phase on the primary phase electrocatalytic metal coating. The preferred palladium metal activator for the reinforcement phase coating is held on the water insoluble polymer in a metal-nitrogen coordination complex. Other noble metals can be used instead of palladium to activate the subsequent electroless metal/phosphorous alloy coating on the primary electrocatalytic metal phase. Subsequent to the application of the water insoluble polymer containing the preferred palladium in a nitrogen-metal coordination complex, the metal is reduced by conventional methods so as to promote the consistent and even distribution of the metal/phosphorous ahoy plating solution as a secondary, reinforcement phase coating on the electrocatalytic metal primary phase coating.

In addition to a process for activation of a substrate prior to electroless deposition of a metal there is also disclosed a process for activation of a substrate which is applicable to non-metal as well as metal substrates. In this process, a substrate is activated by applying to said substrate an adhesion promoting, water insoluble polymer and a platinum group compound, preferably, a palladium compound and the compound is reduced to the metal by contact with a reducing agent either prior to electroless deposition or simultaneously with electroless deposition by exposing the preferred palladium compound to an aqueous coating solution comprising a metal compound and a reducing agent. Suitable water insoluble polymers are polymers and copolymers having a ligand containing a nitrogen group. Preferably, the polymers and copolymers are selected from the group consisting of polymers and copolymers of poly (4-vinylpyridine), poly(2-vinylpyridine), poly (aminostyrene), poly(vinylcarbazole), poly(acrylonitrile), poly(methacrylonitrile), and poly(allylamine). Such polymers contain a nitrogen-containing functional group in which the nitrogen has a lone pair of electrons which can form a coordination complex with a metal ion or a compound of a metal.

DESCRIPTION OF THE PREFERRED EMBODIMENTS

The present invention in one aspect is a novel electrode, preferably, a cathode and a method for preparing an electrocatalytic electrode by depositing a suitable coating comprising an electrocatalyst onto a metallic-surfaced substrate. The method of the invention yields a porous, multi-phase, dendritic, heterogeneous coating comprising an electrocatalyst that is tightly adhered to the substrate. In another aspect, the present invention is a process for catalizing a metal or non-metal substrate surface prior to electroless deposition of a metal.

FIG. 1 is an approximately 3000 times magnified diagrammatic representation of the primary phase of the porous electrocatalytically active cathode coating before application of the reinforcement coating phase. Substrate 10, the multicomponent, primary phase agglomerate 12 containing electrocatalytic metal matrix 13 and metal oxide particles 15 and pores 16 are shown. The dendritic nature of the primary phase coating is evident.

Figure 2:
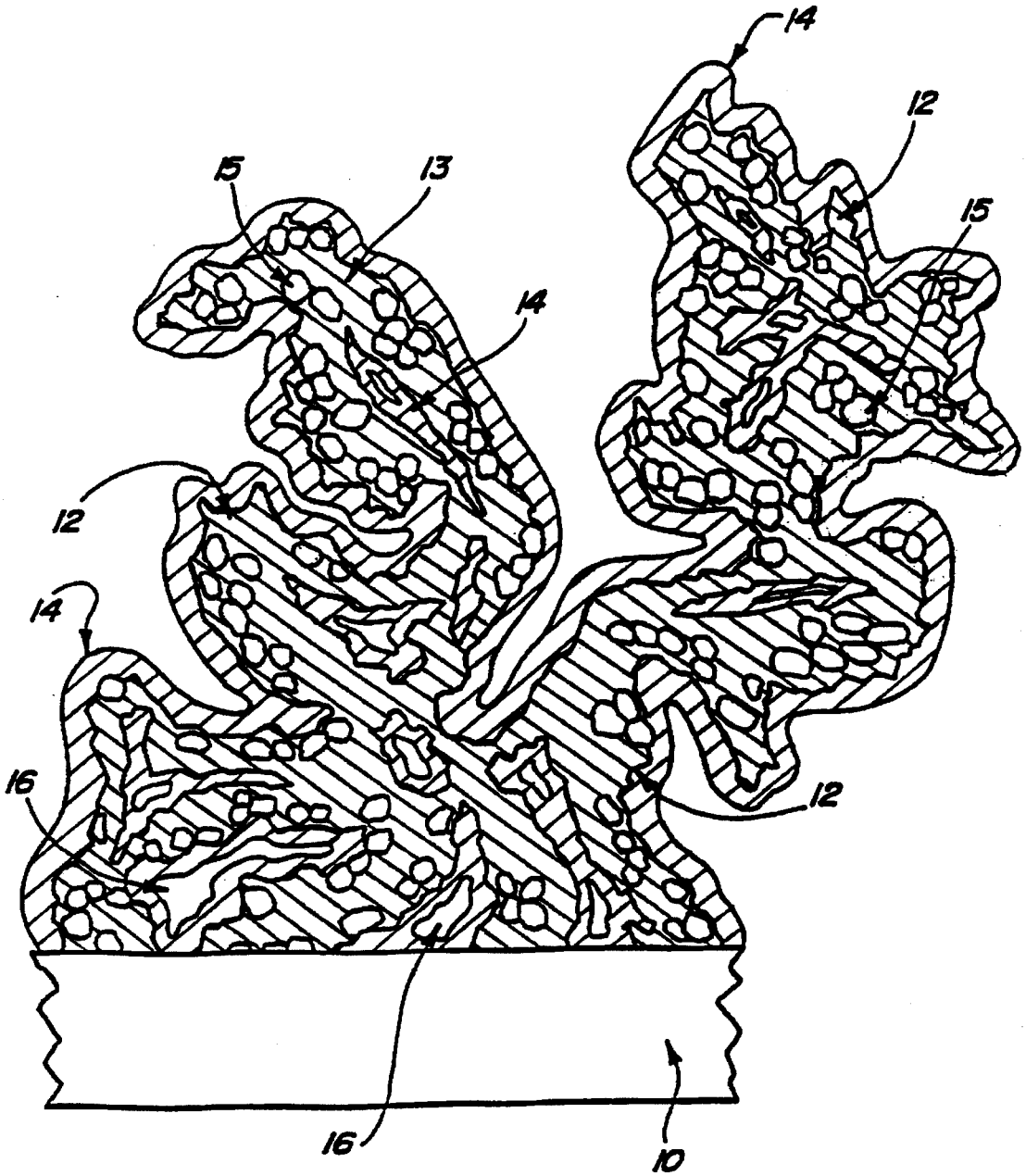
FIG. 2 is an approximately 3000 times magnified representation of a cross section of a substrate showing one embodiment of the cathode coating of the invention.

FIG. 2 is an approximately 3000 times magnified diagrammatic representation of a cross-sectional view of one embodiment of the cathode coating of the invention showing an electrically conductive substrate 10, a primary phase agglomerate 12, containing electrocatalytic metal 13, metal oxide particles 15, a secondary phase reinforcement coating 14, and pores 16.

Substrates suitable for use in preparing cathodes according to the invention have surfaces of electrically conducting metals. Such metallic-surfaced substrates can be formed, generally, of any metal which substantially retains its physical integrity during both preparation of the cathode and its subsequent use in an electrolytic cell. The substrate is, preferably, a transition metal alloy or oxide such as iron, steel, stainless steel, nickel, cobalt, silver and copper and alloys thereof. Preferably, a major component of said alloys is iron or nickel. Nickel is preferred as a cathode substrate, since it is resistant to chemical attack within the basic environment of the catholyte in a chlor-alkali cell.

Metal laminates comprising a base layer of either a conductive or non-conductive underlying material, with a conductive metal affixed to the surface of the underlying material, are, generally, also used as substrates. The means by which the metal is affixed to the underlying material is not critical. For example, a ferrous metal can act as the underlying material and have a layer of a second metal, such as nickel, deposited or welded thereon. Nonconductive underlying materials, such as polytetrafluoroethylene or polycarbonate can be employed when coated with a conductive metal surface onto which electrocatalytic metals are then deposited as described herein. Thus, the metallic surfaced substrate may be entirely metal or an underlying non-electrically conducting material having a metallic surface thereon.

The configuration of the metallic-surfaced substrate used to prepare cathodes according to the present invention is not critical. A suitable substrate may, for example, take the form of a flat sheet, a curved surface, a convoluted surface, a punched plate, a woven wire screen, an expanded mesh sheet, a rod, a tube, etc. Preferred substrate configurations are a woven wire screen and an expanded mesh sheet. In "zero-gap" chlor-alkali cells, particularly good results are obtained by use of a thin substrate, for example, a fine woven wire screen made of cylindrical wire strands having a diameter of about 0.006 to about 0.010 inches. Other electrolytic cells may employ cathodes of mesh sheets or flat plate sheets which are bent to form "pocket" electrodes having substantially parallel sides in a spaced-apart relationship, thereby substantially forming a U-shape when viewed in cross section.

In the process of the invention for the preparation of a cathode, the metallic-surfaced substrate is preferably roughened prior to contact with the base coating solution in order to increase the mechanical adhesion of the base coating as well as to increase the effective surface area of the resulting cathode. This roughened effect is still evident after deposition of electrocatalytic metal on the substrate as disclosed herein. As previously described, an increased surface area lowers the overvoltage requirement. Suitable techniques to roughen the surfaces include sandblasting, chemical etching and the like. The use of chemical etchants is well known and such etchants include most strong inorganic acids, such as hydrochloric acid, sulfuric acid, nitric acid, and phosphoric acid. Hydrazine hydrosulfate is also suitable as a chemical etchant.

It is advantageous to degrease the metallic-surfaced substrate with a suitable degreasing solvent prior to roughening the surfaces. Removal of grease deposits from the substrate surfaces is desirable, in many instances, to allow chemical etchants to contact the substrate and uniformly roughen the surfaces thereof. Removal of grease also allows for good contact between the substrate and coating solution to obtain a substantially uniform deposition of metal and metal oxide thereon. Suitable degreasing solvents are most common organic solvents such as acetone and lower alcohols, as well as halogenated hydrocarbon solvents like 1,1,1-trichloroethane marketed commercially as CHLOROTHENE® brand solvent by The Dow Chemical Company. Removal of grease is useful even where roughening of the surfaces is not desired.

The primary phase in one embodiment of the cathode coating of this invention comprises an electrocatalytic metal and a particulate material. The particulate material, generally, can be any inorganic oxide, preferably, an electrically conductive metal oxide, most preferably, oxides of ruthenium, iridium, rhodium, and platinum. Preferred electrically conductive oxides include platinum group metal oxides and oxides of chromium, molybdenum, technetium, tungsten, manganese and lead. The primary phase can be prepared by alternative methods of deposition, for instance, electrodeposition, thermal spraying, the application of a coating from a slurry of an electrocatalytically active metal compound or metal oxide particles followed by sintering, and, finally, by a preferred non-electrolytic reductive deposition, otherwise known as electroless deposition.

In the electrodeposition method, a platinum group metal compound solution such as $RuNOCl_3$ or Ru nitrosylsulphate solutions suitable for deposition of ruthenium can be used. See M. H. Lietzke and J. C. Griess, Jr., *J. Electrochemical Society,* 100, 434 (1953). In this article a platinum group metal oxide powder is taught as being plated by electrodeposition when present as a dispersion with a ruthenium compound solution. Ruthenium can also be electrodeposited with platinum from an aqueous solution containing both platinum and ruthenium salts, as described in M. P. Janssen and J. Moolhuysen, *Electrochemica Acta,* 21, 861 and 869 (1976). A platinum group metal oxide powder can be added to the above solution and electrodeposited onto a metal substrate.

In the thermal spraying method, the platinum group metal and the metal oxide powder mixture are applied to a metal substrate using a plasma spray or arc-spray apparatus.

In the method in which the coating is applied as a mixture of electrocatalytically active metal and metal oxide powders which are applied from a slurry containing a dispersing medium and an organic binder, such as a polymer or a surfactant, subsequent to application of the slurry to the substrate the coating is sintered to bind the coating to the substrate.

In the non-electrolytic reductive deposition method, a water soluble platinum group metal in ionized form is deposited in admixture with an insoluble platinum group metal oxide which is deposited from a dispersion. This method of deposition of a platinum group metal from a water soluble precursor compound of a platinum group metal is thermodynamically driven and occurs spontaneously by contacting a metal surface with a coating solution containing platinum group metal ions having a pH of less than about 2.8. In the non-electrolytic deposition method, ions from the metal substrate are generated and can be included as components of the primary phase coating. The platinum group metal functioning as a matrix is deposited so as to entrap the particulate material, for instance, platinum group metal oxide particles, resulting in a porous, dendritic, heterogeneous, agglomerated coating.

Useful platinum group metals with which to form the primary phase matrix are platinum, ruthenium, osmium, palladium, rhodium, and iridium. Platinum group metal oxides are the preferred particulate materials. Useful platinum group metal precursor compounds, generally, include platinum group metal compounds selected from the group consisting of metal halides, sulfates, nitrates, nitrites, phosphates. Preferred platinum group metal precursor compounds are platinum group metal halides, nitrates, and phosphates with platinum group metal chlorides being the most preferred compounds.

Preferred coating solutions include at least one electrocatalytic platinum group metal compound soluble in water or an aqueous acid. Preferred coating solutions also include at least one water or aqueous acid insoluble platinum group metal oxide present in dispersion form. The preferred platinum group metal oxides have a particle size of 0.2 to about 50 microns, preferably about 0.5 to about 20 microns, and, most preferably, about 1 to about 10 microns. Generally, any insoluble particulate material is used in admixture with the soluble electrocatalytic platinum group metal compound.

A suitable electrocatalytic metal is, generally, one that is more noble than the metal employed as a substrate, i.e., the electrocatalytic metal precursor compound has a heat of formation that is greater than the heat of formation for the substrate metal in solution. For example, if nickel is selected as the electrode substrate and ruthenium chloride is selected as the electrocatalytic metal precursor compound, non-electrolytic reductive deposition occurs as a result of the following reaction:

$$2RuCl_3+3Ni \rightarrow 2Ru+3NiCl_2 \quad (1)$$

The heat of formation for ruthenium trichloride is about −63 kcal/mole, while the heat of formation for nickel dichloride is about −506 kcal/mole. The reaction proceeds due to the greater stability of the products relative to the reactants, i.e., the difference in the heats of formation between ruthenium trichloride and nickel dichloride drives reductive deposition. To obtain suitable results, the difference should be on the order of about 150 kcal/mole and, preferably, is at least about 300 kcal/mole.

The electrocatalytic metal primary phase coating solution, optionally, includes at least one water soluble palladium metal promoter compound such as a water soluble palladium salt. It is known from U.S. Pat. No. 5,066,380 that the presence of palladium metal ions in the coating solution, in addition to the metal ions of the primary electrocatalytic metal precursor compound, unexpectedly promotes deposition of the primary electrocatalytic metal onto the non-valve metal-surfaced substrate and, thereby, improves electrocatalyst loading. Examples of suitable palladium metal compounds are palladium halides and palladium nitrate.

The concentration of the optional palladium metal ions in the primary phase coating solution should be sufficient to promote improved electrocatalyst loading on the non-valve metal-surfaced substrate. The palladium precursor compounds when present are, generally, included in an amount sufficient to yield a palladium metal ion concentration in the coating solution of at least about 0.001% by weight based on the weight of the solution. The palladium metal ion concentration suitably can be about 0.001% to about 5%; preferably, from about 0.005% to about 2% and, most preferably, from about 0.01% to about 0.05%, by weight of the coating solution. A weight percentage of less than about 0.001% is generally insufficient to promote deposition of the electrocatalytic metal. A weight percentage greater than about 5% results in the deposition of an excessive amount of electrocatalytic metal primary phase of the coating on the substrate.

The reinforcement phase of the electrocatalytically active cathode coating of the invention, generally, comprises a transition metal or an alloy of a transition metal, such as a nickel-phosphide or a nickel-boride. Non-noble metals such as nickel or cobalt are preferred. The reinforcement phase coating is applied after the application of the primary phase electrocatalytically active coating. An optional baking step can take place prior to the application of the reinforcement phase in order to convert the entrapped substrate ions (e.g., $NiCl_2$) formed in reaction (1) and entrapped platinum group metal compound (e.g., $RuCl_3$) in the primary phase to their oxides. Baking to convert metals to oxides can take place at a temperature of about 450° to about 550° C. for a period of 30 to 90 minutes.

The preferred reinforcement phase metal plating solution should provide a metal concentration, on the metal basis, of generally, of about 0.05 percent to about 5 percent, preferably, about 0.1 percent to about 2 percent, and, most preferably, about 0.2 percent to about 1 percent. The preferred nickel plating solutions, generally, contain a proportion of nickel dichloride hexahydrate. Generally, the total weight of the metal or metal alloy of the reinforcement phase of the electrocatalytically active cathode coating of the invention which is applied to the outer surface, inner surfaces of the pores within the primary phase and at the interstitial areas at the boundary of the primary phase and the substrate, is in the range of about 200 micrograms to about 10 milligrams per square centimeter of geometric area, preferably, about 500 micrograms to about 5 milligrams per square centimeter, and most preferably, about 800 micrograms to about 3 milligrams per square centimeter.

In the preparation of the primary phase coating, the electrocatalytic metal precursor compound can be present in the primary phase coating solution in amounts sufficient to deposit an effective amount of the metals on the substrate. The concentration of primary electrocatalytic metal ions in the base coating solution, in terms of weight percent, is, generally, from about 0.01 percent to about 5 percent, preferably, from about 0.1 to about 3 percent and, most preferably, from about 0.2 percent to about 1 percent by weight of solution. An electrocatalytic metal ion concentration of greater than about 5 percent is not desired, because an unnecessarily large amount of platinum group metal is used to prepare the coating solution. An electrocatalytic metal ion concentration of less than about 0.01 percent is not desired, because undesirably long contact times are required. The concentration of platinum group metal oxide in the primary phase coating solution is, generally, about 0.002 to about 2 percent, preferably, about 0.005 to about 0.5 percent, and most preferably, about 0.01 to about 0.2 percent. If optional secondary electrocatalytic metals are desired to be included in the primary phase coating, the concentration of secondary electrocatalytic metal ions in the coating solution, in terms of weight percent, is, generally, up to about 2%; preferably, up to about 1% and, most preferably, up to about 0.5% by weight of solution.

The pH range for the primary phase coating solution is, generally, 0 pH to about 2.8 pH. Precipitation of hydrous platinum group metal oxides results at higher pHs. A low pH can encourage competing side reactions such as the dissolution of the substrate.

The pH of the primary phase coating solution may be adjusted by inclusion of organic acids or inorganic acids therein. Examples of suitable inorganic acids are hydrobromic acid, hydrochloric acid, nitric acid, sulfuric acid, perchloric acid, and phosphoric acid. Examples of organic acids are acetic acid, oxalic acid, and formic acid. Hydrobromic acid and hydrochloric acid are preferred.

The rate at which the electrocatalytic metal deposits to form the primary phase on the electrically conductive metal-surfaced substrate is a function of the coating solution temperature. The temperature, generally, ranges from about 25° C. to about 90° C. Temperatures below about 25° C. are not useful, since uneconomically long times are required to deposit an effective amount of electrocatalytic metal on the substrate. Temperatures higher than about 90° C. are operable, but generally result in an excessive amount of metal deposition and side reactions. A temperature ranging from between about 40° C. to about 80° C. is preferred, with about 45° C. to about 65° C. being a most preferred temperature range.

The reinforcement phase of the coating is, generally, applied from a non-noble or transition metal aqueous coating solution, preferably, a nickel dichloride hexahydrate coating solution at a solution pH, generally, of about 7 to about 10, preferably, about 8 to about 9. The pH can be adjusted by the inclusion of ammonium hydroxide or other bases.

The rate at which the reinforcement phase coating is deposited on the electrode of the invention is a function of the coating solution temperature as well as the effectiveness with which the surface of the primary phase coating of catalytic metal and other surfaces are activated by the use of the coating of a water insoluble polymer and palladium metal. At a coating temperature from about 20° C. to about 65° C., an effective amount of non-noble metal or alloy or transition metal or alloy coating can be applied to the substrate. An increased coating rate results as the temperature is raised. The preferred coating rate occurs at a temperature of about 20° C. to about 30° C.

Contact between the primary phase coating solution and a non-valve metal-surfaced substrate is achieved by any convenient method. Typically, at least one surface of the substrate is dipped into the coating solution, or the coating solution can be applied by painting methods, such as application with a brush or a roller. A preferred method is immersion of the substrate in a bath of the primary phase coating solution, since the coating solution temperature can be more accurately controlled. Those skilled in the art will recognize that many equivalent methods exist for contacting the substrate with the solution.

The contact time should be sufficient to deposit an effective amount of the primary phase coating of a platinum group metal and preferred platinum group metal oxide electrocatalyst on the substrate surface. An effective thickness of the primary phase is, generally, about 5 to about 70 microns. An effective amount of deposition of both the elemental metal and combined oxide forms an electrocatalytic metal loading of, generally, about 50 ug/cm$^2$ to about 2000 ug/cm$^2$ calculated as the metal in the "atomic" form. The amount of metal in the primary phase is measured by x-ray fluorescence methods. A preferred loading for both the elemental metal and combined oxide is from about 400 ug/cm$^2$ to about 1500 ug/cm$^2$ with a most preferred loading of from about 500 ug/cm$^2$ to about 1000 ug/cm$^2$. Loadings less than about 50 ug/cm$^2$ are generally insufficient to provide a satisfactory reduction of cell overvoltage. Loadings greater than about 2000 ug/cm$^2$ do not significantly reduce the applied overvoltage when compared to lesser loadings within the preferred range. It should be understood that the effective amount of deposition specified above refers only to loading of the primary phase platinum group electrocatalytic metal and metal oxides and does not include the amount of an optional palladium metal promoter which can be used to provide increased loading or any optional secondary electrocatalytic metal including the metal of the non-valve metal substrate which is coated.

The contact time for coating the reinforcement phase of the coating can vary from about 5 minutes to about 90 minutes. The contact time required for achieving an adequate reinforcement phase layer of the transition metal or alloy thereof will vary with coating solution temperature, pH, the preferred palladium metal concentration in the electroless coating activation intermediate layer, the concentration of the transition metal compound and the amount of reducing agent in the coating solution. In the following description, palladium metal is described as the preferred metal component of the intermediate layer. Other platinum group metals which can be substituted for palladium metal as an activator include silver, gold, copper, platinum, rhodium, iridium, ruthenium, and osmium. Heating may be required to facilitate reaction between the metal compounds and the nitrogen functional group on the polymer. The contact time for coating the reinforcement phase layer should be sufficient to deposit an amount effective to bind the primary phase agglomerates together and to the electrically conducting substrate. Generally, the reinforcement phase has a coating thickness of about 0.01 to about 3 microns and, generally, a coating weight of about 200 ug/cm$^2$ to about 10 mg/cm$^2$, calculated as the metal in the atomic form.

Generally, the time allowed for contact between the primary phase coating solution and the transition metal or metal-surfaced substrate can, generally, vary from about one minute to about 50 minutes. However, it should be understood that the contact time required will vary with coating solution temperature, platinum group metal concentration, and palladium ion concentration. Contact times of from about five minutes to about 30 minutes are, preferably, with from about 10 minutes to about 20 minutes being most preferred. Metals will deposit onto the substrate at times of less than one minute, but the amount of deposition is usually insufficient to provide an effective amount of electrocatalytic metals and therefore, requires repeated contact with the coating solution. Generally, if shorter contact times are desired, the method of the present invention may be repeated a plurality of times until an effective amount of the primary platinum group electrocatalytic metals deposit on the metal surface of the substrate. It is preferred to apply an effective amount of the electrocatalytic metals to the substrate surface in a single application. Generally, times in excess of about 50 minutes provide no discernible advantage, because an unnecessary and excessive amount of electrocatalytic metal will deposit.

It is advantageous to rinse the coated substrate with water or other inert fluid after contact with the coating solutions, especially where a strong inorganic acid, such as hydrochloric acid, is incorporated in the coating solution. The rinse minimizes possible removal of deposited metals from the coated substrate due to corrosive action by the acid.

In addition to the use of palladium to promote catalyst loading of the primary phase catalytic coating, it has been found that palladium metal or a palladium compound complexed with an adhesion promoting polymer and, thereafter, reduced to palladium metal in colloid form renders more effective a subsequently applied coating of the reinforcement phase coating as well as improves the adhesion of the primary phase and the reinforcement phase of the coating.

From U.S. Pat. No. 4,061,802 it is known to activate a substrate with a palladium-tin activator prior to electroless deposition. This activator is activated by an acceleration step. In U.S. Pat. No. 4,798,662, an aqueous solution of palladium dichloride is used to activate a previously applied coating of ruthenium trichloride on a nickel plate prior to electroless deposition of an aqueous solution of a nickel salt containing hypophosphate ion as a reducing agent for the palladium. It is also known from U.S. Pat. No. 4,764,401 and *J. Electrochemical Society* 137, 95 (1990) to activate a substrate surface to be metalized by electroless deposition by the application of a water soluble polymer with palladium ions. In U.S. Pat. No. 4,764,401, a complex is formed by reacting palladium dichloride and an organic ligand in order to fix the palladium on the surface of the substrate.

It has been found that, generally, a platinum group metal, preferably, a palladium metal precursor compound is useful in association with a water insoluble adhesion promoting polymer which is applied as the first layer of the reinforcement phase. Reducing the preferred palladium precursor compound to the metal is required either as a separate process step or simultaneously with the deposition of the second layer of the reinforcement phase. While not wishing to be bound by theory, it is believed that the porous, dendritic, catalytic base coating applied to the transition metal substrate requires the use of an adhesion promoting layer over the primary catalytic coating in order that the reinforcement phase of a transition metal or alloy thereof can be effectively deposited with sufficient adhesion on and within the pores of the primary phase electrocatalytic metal, at the boundaries of the primary phase, and on the substrate. Useful transition metal or alloy coatings thereof of the electrocatalytic reinforcement phase are, for instance, metals such as nickel, cobalt, iron, titanium, hafnium, niobium, tantalum, and zirconium. Preferably, nickel, cobalt, copper, and their phosphorus, sulphur, or boron alloys are employed. Examples of suitable water soluble non-valve metal compounds forming the reinforcement phase are nickel halides and nickel acetate.

The adhesion promoting water insoluble polymer-palladium complex intermediate layer is applied to the primary phase as a complex of said polymer and a palladium metal precursor compound. Alternatively, the polymer and the palladium precursor compound can be applied separately. The polymer can be the preferred poly(4-vinlypyridine). Preferably, the water insoluble polymer is present as an organic solvent solution or as an aqueous dispersion. The intermediate layer is, generally, applied from a uniform liquid mixture, preferably, a homogeneous solution or dispersion wherein the coating precursor materials are dissolved or in dispersion form. Emulsions of the polymer in admixture with a solution of a palladium compound can be used. Organic solvents used to dissolve the polymer can be conventional solvents such as dimethyl formamide (DMF) or isopropyl alcohol (2-propanol). Preferably, the polymer or copolymer used to form the intermediate layer is a polymer or copolymer containing a nitrogen-containing functional group in which the nitrogen has a lone pair of electrons which permit the nitrogen to form a coordination complex with a metal ion or compound of a metal. Poly(4-vinylpyridine) is preferred. Other useful polymers include polymers and copolymers of poly(vinylcarbazole), poly(2-vinylpyridine), poly(acrylonitrile), poly(methacrylonitrile), poly(allylamine), and poly(aminostyrene).

The concentration of polymer in the intermediate layer coating solution can be, generally, about 0.01 percent by weight to about 5 percent by weight, preferably, about 0.01 to about 2.5 percent, and, most preferably, about 0.02 to about 1 percent. The concentration of the preferred palladium metal precursor compound in the intermediate layer coating solution is, generally, about 0.001 percent by weight to about 5 percent by weight, preferably, about 0.005 to about 1 percent, and, most preferably, about 0.01 to about 0.4 percent. Preferred palladium metal precursor compounds are palladium halides and palladium nitrate. The preferred palladium metal precursor compound can be applied in admixture with the intermediate polymer coating solution or, alternatively, applied subsequently or prior to the application of the intermediate polymer coating solution.

In one preferred embodiment of the process of the invention, an electrode is produced by coating a metal-surfaced substrate with a primary phase coating from an aqueous mixture comprising a platinum group metal in admixture with a dispersion of a platinum group metal oxide. Inclusion of a water soluble palladium salt in the aqueous base coating mixture can improve the coating deposition rate. Thereafter, after an optional baking and drying step, an adhesion promoting water insoluble polymer in admixture with a water soluble palladium salt is applied to the primary phase as an intermediate layer and finally a reinforcement phase comprising a metal or alloy thereof is applied over the intermediate layer.

In another preferred embodiment, a soluble palladium metal salt can be applied subsequent to or prior to the application of the intermediate polymer coating. The use of an adhesion promoting reinforcement layer on the surfaces of the primary phase catalytic layer provides an electrode characterized by increased adhesion of the primary phase on the substrate such that the primary phase primary catalytic layer is rendered resistant to coating loss, for instance, during operation of the electrode in an electrolytic "zero-gap" cell.

SPECIFIC EMBODIMENTS OF THE INVENTION

Where not otherwise specified in this specification and claims, temperatures are in degrees centigrade, and parts, percentages, and proportions are by weight.

The following Examples illustrate the present invention and should not be construed, by implication or otherwise, as limiting the scope of the appended claims.

EXAMPLE 1

An electrode is prepared by immersion of a woven nickel wire screen measuring about three inches by three inches in a series of aqueous coating solutions as follows:

a catalytic metal coating solution for forming the primary phase, an intermediate water insoluble polymer adhesion promoting solution, a palladium coating solution, a palladium activation solution, and a nickel-phosphorous alloy coating solution.

The woven nickel wire screen utilized as a substrate has a strand diameter of 0.006 inch and 25 wire strands per inch. Prior to coating, the nickel wire screen is degreased utilizing 1,1,1-trichloroethane. After degreasing, the nickel wire screens is sandblasted to create a rough surface on each wire strand.

A primary phase catalytic metal coating solution is prepared as follows:

| | |
|---|---|
| Ruthenium trichloride hydrate | 1.7 percent |
| 37% hydrochloric acid, | 4.4 percent |
| Palladium dichloride | 0.02 percent |
| Ruthenium dioxide | 0.07 percent |
| Water to 100 percent | |

Particles of ruthenium dioxide are present in the coating solution as a dispersion. The dispersed ruthenium dioxide particles have a typical particle size of about 1 to about 20 microns.

Coating of the woven nickel wire screen is accomplished by dipping the screen in the coating solution described above, maintained at a temperature of about 60° C. After coating, the nickel wire screen is rinsed with water, allowed to air dry and baked one hour at 475° C.

The nickel wire screen is next dipped in a 2-propanol solution of poly(4-vinylpyridine) containing 0.02 percent of the polymer for a period of five minutes at ambient temperature to provide an intermediate coating layer. After drying, the screen is dipped at ambient temperature in an aqueous solution containing two millimolar of palladium dichloride at a pH of 3.0 adjusted with acetic acid. The screen is removed from this solution after about 10 minutes and rinsed with deionized water and, thereafter, is coated with the reinforcement phase by dipping into a solution of sodium hypophosphate, $NaH_2PO_2 \cdot H_2O$, at a concentration of 36 grams per liter and a pH of 3.0 for a period of two minutes or until vigorous hydrogen evolution is observed. Thereafter, the screen is dipped for a period of thirty-five minutes at about room temperature in an aqueous solution of 15.5 grams per liter of $NiCl_2 \cdot 6H_2O$ 2.36 grams per liter of $(NH_4)_2SO_4$ 27.0 grams per liter sodium citrate 18 grams per liter of $NH_4Cl$ 22.4 grams per liter of $NaH_2PO_2 \cdot H_2O$ Concentrated aqueous ammonium hydroxide solution is added to adjust the pH to about 8.8. Upon conclusion of plating the bulk plating solution was found to exhibit essentially no plating.

The catalytic coating applied to the woven nickel wire screen is measured to determine catalyst loading by x-ray fluorescence both before and after testing of the electrode prepared above as a cathode in an electrolytic chlor-alkali cell containing an aqueous catholyte solution of 31–33 percent by weight sodium hydroxide, an aqueous anolyte of NaCl at 220 g/l and maintained at a current density of 2.6 amps per square inch (ASI) and a temperature of about 90° C. The chlor-alkali electrolytic cell utilized for testing the cathode contains a dimensionally stable anode (DSA) inches by three inches and a fluorocarbon ion exchange cell membrane.

Before and after the operation in the test electrolytic cell, the hydrogen evolution potential of the cathode sample was measured in a caustic bath. In this bath, a platinum anode is used. The anode is surrounded with an envelope of an ion exchange membrane made of perfluorosulfonic acid polymer. The cathode under test is attached to a current distributing electrode made of 0.078 inch thick expanded nickel mesh connected to a negative current source and immersed in the test bath.

The hydrogen evolution potential of the cathode is measured utilizing a mercury/mercuric oxide reference electrode and a Luggin probe at the current density of about 2.6 amps per square inch. The cathode after 59 days of operation showed a cathode potential of minus 0.989 volts at 2.6 ASI.

The catalyst loading of ruthenium metal and ruthenium oxide is measured by x-ray fluorescence using a Texas Nuclear Model Number 9256 digital analyzer equipped with a cadmium 109, five millicurie source and filters optimized for measuring ruthenium metal and ruthenium oxide in the presence of nickel. Comparison of the measurement with a standard having a known ruthenium content allows measurement of the loading of the ruthenium on the catalytic electrode. An average ruthenium loading is calculated by taking measurements at four evenly spaced locations on both sides of the coated woven nickel wire screen. The ruthenium present in the catalytic electrode prior to operation in the electrolytic cell is 644 micrograms per square centimeter. The ruthenium present after operation of the electrolytic cell at 2.6 ASI, 90° C. for 59 days is 630 micrograms per square centimeter. This indicates only minor loss of the ruthenium metal and the ruthenium oxide catalyst and the presence of an adherent coating on the electrode substrate. The results are summarized in Table I below.

EXAMPLE 2

Example 1 is repeated. The sample is tested in an electrolytic chlor-alkali test cell over a period of 103 days. The initial ruthenium loading is 635 micrograms per square centimeter and the loading subsequent to evaluation is 590 micrograms per square centimeter. The hydrogen evolution potential in a bath after the 103 day test operation is minus 0.996 volts measured against a mercury/mercuric oxide reference electrode at 2.6 ASI. The results are summarized in Table I below.

EXAMPLE 3

Control, Forming No Part of This Application

The procedure of Example 1 is repeated except that the wire screen is coated only with the primary phase electrocatalytic coating. No intermediate polymer coating containing palladium or reinforcement phase nickel-phosphorous alloy plating is applied. The catalytically coated screen is evaluated only in a caustic bath over a period of one hour. The results of analysis for ruthenium metal and ruthenium oxide in the catalytic electrode before and after testing for one hour in the caustic bath show a 52 percent loss of ruthenium metal and ruthenium oxide catalyst as shown in Table I below. The cathode potential after the one hour test is measured and found to be minus 1.044 volts against a mercury/mercuric oxide reference electrode at 2.6 ASI. Since the coating loss is severe after only one hour evaluation, no long term testing is considered necessary.

TABLE I

Ruthenium loss after operation as cathode in chlor-alkali electrolytic cell.

| | Ru ug/cm$^2$ Initial | Ru ug/cm$^2$ Final | % Loss | Final Cathode Potential |
|---|---|---|---|---|
| Example 1 Electrode | | | | |
| 59 day test | 644 | 630 | 2.2 | −0.989 |
| Example 2 Electrode | | | | |
| 103 day test | 635 | 590 | 7.1 | −0.996 |
| Example 3 Electrode Control | | | | |
| 1 hour test | 803 | 388 | 52 | −1.044 |

EXAMPLE 4

The procedure of Example 1 is repeated except that the primary phase catalytic coating solution is as follows:

| | |
|---|---|
| ruthenium trichloride hydrate | 1.84 percent |
| 37 percent hydrochloric acid | 4.41 percent |
| palladium dichloride | 0.033 percent |
| ruthenium dioxide | 0.13 percent |
| water to 100 percent | |

The primary phase catalytic coating is applied to the substrate over a period of 15 minutes immersion time. The coating is baked at 475° C. for one hour. The woven nickel wire screen is dipped into a solution of 0.05 percent poly (4-vinylpyradine) in 2-propanol for a period of five minutes. After drying, the screen is thereafter dipped for a period of five minutes into a solution of palladium chloride having a concentration of 2 millimolar and a pH of 3 adjusted with acetic acid. After rinsing the treated screen with deionized water, the screen is dipped into a solution of sodium hypophosphate at a concentration of 36 grams per liter, at pH 3, for a period of five minutes and subsequently dipped into an aqueous nickel plating solution having the following composition at room temperature for thirty-five minutes:

| | |
|---|---|
| 20.7 grams per liter | Nickel dichloride hexahydrate |
| 3.15 grams per liter | Ammonium sulphate |
| 36 grams per liter | Sodium citrate |
| 24 grams per liter | Ammonium chloride |
| 30 grams per liter | Sodium hypophosphate monohydrate |

Concentrated ammonium hydroxide is added to adjust the pH to 8.8 to 8.9. After plating the sample with nickel, it is noted that essentially no plating occurs in the bulk plating solution. The sample is rinsed with deionized water and tested in the caustic bath as described in Example 1. The initial hydrogen evolution potential in a zero-gap electrolytic cell configuration is minus 1.012 volts utilizing a mercury-mercuric oxide reference electrode at 2.0 amps per square inch and minus 1.02 volts at 2.6 amps per square inch. The ruthenium loading before testing is 963 micrograms per square centimeter and after one hour of operation, the ruthenium loading is 925 micrograms per square centimeter.

EXAMPLE 5

A nickel expanded mesh having a thickness of 0.02 inches is coated as described in Example 1. Thereafter, the mesh is welded on a heavy mesh and tested in an electrolytic test cell having a DSA anode in a Flemion 865R membrane. The cell is operated at 90° C. and 2.6 ASI with a caustic solution having about 32 percent sodium hydroxide as the catholyte and a sodium chloride concentration of 220 grams per liter as the anolyte. The cell is operated for 56 days, disassembled, and the cathode is tested in a 32 percent caustic bath as described in Example 1. The hydrogen evolution potential was minus 0.992 volts against a mercury/mercuric oxide reference electrode at 2.6 ASI and 90° C. The ruthenium loading before the 56 day test is 906 micrograms per square centimeter. After the test the ruthenium loading is 864 micrograms per square centimeter.

EXAMPLE 6

Control, Forming No Part of This Application

Utilizing a woven nickel wire screen having a strand diameter of 0.006 inch, an electrode is prepared utilizing a coating solution having the following composition:

| | |
|---|---|
| Ruthenium trichloride monohydrate | 1.9 percent |
| Palladium dichloride | 0.024 percent |
| Ruthenium dioxide (powder) | 0.03 percent |
| Nickel dichloride hexahydrate | 2.6 percent |
| 37 percent hydrochloric acid | 4.3 percent |
| Water to 100 percent | |

The woven nickel wire screen is dipped into the above composition at a temperature of 66° C. for a period of time. The screen is removed from the coating solution, dried and baked in an oven at 475° C. for 30 minutes in the presence of air. Thereafter, the coated screen is dipped into a second catalytic coating solution having the following composition:

| | |
|---|---|
| Ruthenium trichloride hydrate | 1.94 percent |
| Nickel dichloride hexahydrate | 1.97 percent |
| Hydrochloric acid at 37 percent | 5.10 percent |
| 2-propanol to 100 percent | |

The coating is baked at 475° C. and dipped and baked a total of three times. The woven nickel wire screen electrode prepared as above is utilized as a cathode in an electrolytic test cell, as described in Example 1, together with a dimensionally stable anode and a Flemion® 865 cell membrane. The cell is operated at a temperature of 90° C. and 2.6 amps per square inch over a period of twenty days. The initial loading of ruthenium on the screen is 637 micrograms per square centimeter. After operation in the cell for a period of twenty days, the ruthenium loading is 201 micrograms per square centimeter.

EXAMPLE 7

Control, Forming No Part of This Application

Example 1 is repeated except that the woven nickel wire screen is not subjected to an intermediate coating containing poly(4-vinylpyridine) prior to coating with the reinforcement phase. Upon treating the primary phase coated woven nickel screen to a 2 millimolar palladium dichloride aqueous solution and rinsing in deionized water, it is discovered that the majority of the palladium dichloride applied on the surface of the base coated screen is washed off the surface by rinsing in the deionized water. The nickel plating reaction which occurs upon dipping the base coated screen into the nickel plating solution set forth in Example 1 is continued for a period of forty minutes. Nickel plating occurs on scattered areas of the screen. The sample is rinsed with water and observed under the microscope. The majority of the surface of the nickel screen appears similar to the surface of the screen prior to exposure to the nickel plating solution.

EXAMPLE 8

Control, Forming No Part of This Invention

Example 1 is repeated except that the woven nickel wire screen coated with the primary phase electrocatalytic coating is not subjected to an intermediate coating of a solution of poly(4-vinylpyridine). The woven nickel wire coated with the primary phase electrocatalytic coating is treated with an aqueous palladium dichloride solution at a concentrate of 2 millimolar. The palladium dichloride nickel wire is then put directly into a 36 gram per liter aqueous sodium hypophosphate monohydrate solution at a pH of 3 and allowed to remain for five minutes. The nickel wire is then put into an electroless nickel plating solution, as described in Example 1. Inconsistent coating results are observed after placing nickel wire screens into the nickel plating solution. For instance, a very long induction time which was greater than 10 minutes is observed before the onset of the hydrogen evolution indicating plating has started. In addition, a vigorous plating reaction occurs in the bulk plating solution at the same time that uneven plating occurs on the woven wire screen. Rapid decomposition of the plating solution is observed with a large amount of nickel flakes appearing on the bottom of the plating solution container. The deposition of the nickel-phosphorous layer on the woven wire screen is inconsistent and uneven.

EXAMPLE 9

Control, Forming No Part of This Application

An expanded nickel mesh screen having a thickness of 0.078 inches is coated using the following coating solution:

| | |
|---|---|
| ruthenium trichloride monohydrate | 2.3 percent |
| 37 percent aqueous hydrochloric acid | 7.0 percent |
| 2-propanol to 100 percent | |

The nickel mesh screen was cleaned and sandblasted before coating by dipping in the above coating solution. After the solvent is evaporated, the coating is baked at a temperature of 450° to 550° C. for thirty minutes. The dipping and baking procedure above is repeated until the desired ruthenium loading is achieved. A final baking of the coated nickel wire is conducted at a temperature of 450° to 500° C. for sixty to ninety minutes. A sample prepared following the above procedure is found to have a ruthenium loading of 698 micrograms per square centimeter. Thereafter, the nickel coated wire was dipped into the water insoluble polymer adhesion promoting solution of Example 1 and the palladium coating solution described in Example 1 prior to coating with the reinforcement phase coating described in Example 1. The electrode is evaluated by testing in a caustic bath, as described in Example 1. The hydrogen evolution potential at 2.6 ASI is found to have a range of potential of minus 1.012 volts to minus 1.068 volts with an average of minus 1.041 volts against a mercury/mercuric oxide reference electrode.

EXAMPLE 10

Control, Forming No Part of This Invention

A cathode coating is prepared utilizing a similar dipping and baking procedure as described in Example 9 except that the primary phase catalytic metal coating solution, as described in Example 1, additionally contains 2.3 percent by weight of nickel dichloride hexahydrate. After the dipping and baking procedure to apply the primary phase coating, the coated wire screen is treated with the water insoluble polymer solution of Example 1 and the palladium dichloride solution of Example 1 and finally treated with a nickel and phosphorous electroless coating solution to apply the reinforcement phase coating, in accordance with the procedure of Example 1. The electrode is evaluated in a caustic bath as described in Example 1. At 2.6 ASI, the coated screen has a hydrogen evolution potential of minus 1.030 to minus 1.062 volts with an average of minus 1.042 volts against a mercury/mercuric oxide reference electrode.

EXAMPLE 11

Control, Forming No Part of This Invention

A cathode coating is prepared as in Example 10 but without the application of the reinforcement phase coating. The woven screen when evaluated in a caustic bath as described in Example 1 shows a hydrogen evolution potential of minus 1.00 volts at 2.6 ASI when measured against a mercury/mercuric oxide reference electrode.

The porous, primary phase cathode coating disclosed in this invention has a large amount of internal surface areas located around small pores in the coating. Preferably, the internal surface area is about equal to the external surface area, generally, the internal surface area is about 50 percent to about 150 percent of the external surface area. This corresponds to an internal to external surface area ratio of about 0.5 to about 1.5. When these internal surface areas are not exposed to the water insoluble polymer, palladium, and nickel-phosphorous coating solutions, these areas continue to show electroactivity subsequent to the application of the reinforcement phase. If the primary phase catalytic coating does not have a large amount of internal surface area and is coated with the reinforcement phase, a significant decrease in the electrocatalytic activity of the primary phase areas can be expected with the result that the electrode will exhibit a higher hydrogen evolution potential.

As noted above, Control Examples 9 and 10 when evaluated in a caustic bath show significantly higher average hydrogen evolution potential with a large variation in hydrogen evolution potential in comparison with the cathode of the present invention, as described in Example 1 and in comparison with Control Example 11. This result indicates that the internal surface areas associated with the primary phase electrocatalytic metal and metal oxide agglomerates of the present invention have unique properties. The apparent lack of a sufficient amount of internal surface areas in the catalytic coatings of Control Examples 9 and 10 can lead to higher cathode evolution potential subsequent to the application of the reinforcement phase.

The poly(4-vinylpyridine) used in the above Examples is obtained from Monomer-Polymer and Dajac Laboratories Incorporated. It has a molecular weight of $5\times10^4$. This is dissolved in 2-propanol to make 0.02 to 0.2 percent by weight solutions. The ruthenium chloride and ruthenium dioxide are both obtained from Johnson Matthey Company and the palladium dichloride is obtained from the Aldrich Chemical Company. All other chemicals utilized in the above Examples are reagent grades and are used as received from the supplier.

EXAMPLES 12–14

Circular plates of polycarbonate are plated with a nickel/phosphorous alloy coating utilizing the following procedure. The plates of polycarbonate are sandblasted with aluminum oxide, cleaned with acetone, and allowed to dry. Three polycarbonate plates are then separately dipped in a 0.01, 0.05, or 0.5 percent by weight solution of poly(4-vinylpyridine) (PVP) in 2-propanol for period of 2 minutes and allowed to drain and air dry. Thereafter, each polycarbonate plate is dipped into a 5 millimolar palladium dichloride solution containing 0.2 molar acetic acid at a pH of 3.06 for a period of 5 minutes and then washed thoroughly with water. Thereafter, each plate is dipped into a 36 grams per liter sodium hypophosphate solution at a pH of 3.14 for a period of 6 minutes in order to reduce the palladium ions to palladium metal. Next, the polycarbonate plates are dipped into a nickel plating solution having the following composition:

| | |
|---|---|
| Nickel dichloride hexahydrate | 46.5 grams per liter |
| Ammonium sulphate | 7.07 grams per liter |
| Ammonium chloride | 54 grams per liter |
| Sodium citrate | 81 grams per liter |

The pH of the nickel plating solution is adjusted to 8.6 using ammonium hydroxide. During the 6 minute term of exposure of the polycarbonate plates to the nickel plating solution the evolution of hydrogen is rapid indicating the vigorous plating reaction of nickel on the polycarbonate plates. The nickel plating reaction is allowed to proceed at room temperature for 50, 50, and 35 minutes, respectively. The resulting nickel/phosphorous coating on the polycarbonate plate is evaluated for conductivity utilizing a push-pin type probe (HP 4328A milliohmeter) at a distance apart of 2 centimeters. Results are shown in Table II below:

TABLE II

| Ni—P plating on polycarbonate | | | | |
|---|---|---|---|---|
| Example | PVP (Percent) | Plating Time Minutes | Coat weight ($mg/cm^2$) | Resistance (Ohm) |
| 12 | 0.01 | 50 | 0.65 | 3.4–4.8 |
| 13 | 0.05 | 50 | 1.17 | 1.8–2.6 |
| 14 | 0.50 | 35 | 2.63 | 1.9–2.6 |

EXAMPLE 15

The electrode of the invention provides improved poisoning resistance. When poisoning occurs to a hydrogen evolution cathode, an increase in the hydrogen evolution potential occurs. It is believed that the cathode of the invention provides improved poisoning resistance partly because of its morphological characteristics. For instance, an electrode having a rough, dendritic surface can make the deposition of a layer of iron or other poisoning metal (e.g., mercury) more difficult and even if the poisoning metal is successful in depositing on the cathode, it is expected to form a loose deposit which is likely to be easily carried away by the hydrogen evolution occurring at the cathode in a chlor-alkali cell.

It is believed that the poisoning resistance of the electrode of the invention is the result of the large amount of internal surface area associated with the porous, dendritic electrode coating. The electroactive internal surface areas are not easily accessible to an impurity species because of the long path the impurity ions must take to diffuse into the electrode from the electrolyte solution to which the electrode is exposed during use.

In order to evaluate the iron poisoning resistance of the cathode of the invention, a test is conducted by polarizing a cathode prepared in Example 6 in a 32 percent by weight caustic solution containing 6 parts per million of iron at 0.22 amps per square inch. Previous experiments have indicated that poisoning at this low current density is either similar to or more severe than that which occurs at 2.6 amps per square inch. Periodically the hydrogen potentials are examined at 2.6 amps per square inch during the test procedure. During a 6 hour test, a cathode which is prepared in accordance with Example 1 showed very little increase in the hydrogen evolution potential at 2.6 amps per square inch. The range of the increase in cathode potential for the cathode of Example 1 is between 5 and 15 millivolts. This is practically unchanged. Evaluation of the anode of Example 15 in an electrolytic cell having a DSA anode and an ion exchange membrane provided the same cell voltage, within experimental error, in comparison with a similar electrode not subjected to the iron poisoning resistance test described in Example 15.

EXAMPLE 16

Control, Forming No Part of This Application

A cathode having a very flat metallic surface is prepared by a non-electrolytic reductive deposition process. No dispersed platinum group metal oxide powder is present in the coating solution. The solution composition is as follows:

| | |
|---|---|
| ruthenium trichloride hydrate | 1.84 percent |
| palladium dichloride | 0.033 percent |
| 0.44 normal hydrochloric acid to 100% | |

A 0.006 inch nickel woven wire screen is coated with the above solution. After non-electrolytic reductive deposition the woven wire screen is baked in an oven having circulated air at 475° C. for about 45 minutes. The coated 0.006 inch nickel woven wire is welded to a 0.078 inch nickel mesh and then evaluated for iron poisoning in accordance with the procedure of Example 15. The test results show a range of increase in potential of about 40 to about 90 millivolts. Evaluation of this electrocatalytically coated nickel woven wire screen in an electrolytic test cell with a DSA anode and an ion exchange membrane shows a cell voltage 100 millivolts higher than a cell with the same cathode which was not subjected to the iron poisoning test of Example 15.

EXAMPLE 17

Control, Forming No Part of This Application

A cathode coating is prepared by the dipping and baking procedure described in Example 9. Only the primary phase electrocatalytic coating was applied to the electrode substrate. The cathode is evaluated for iron poisoning in accordance with the procedure of Example 15. Test results show a range of increase in potential between about 10 millivolts to about 45 millivolts.

EXAMPLES 18–32

Example 1 is repeated except that the nickel wire screen electrode substrate is successively replaced with a wire screen made of iron, stainless steel, silver, and copper.

Example 1 is repeated except that the ruthenium dioxide particulate material is successively replaced with the following particulate materials: platinum oxide, palladium oxide, iridium oxide, osmium oxide, and rhodium oxide.

Example 1 is repeated except that the nickel-phosphide alloy reinforcement phase coating is successively replaced with a metal or metal alloy as follows: cobalt, nickel, cobalt-phosphide, cobalt boride, nickel sulfide, and nickel boride.

Example 1 is repeated except that the water soluble ruthenium trichloride utilized to form the primary phase matrix is successively replaced with water soluble platinum chloride, rhodium nitrate, palladium phosphate, and palladium chloride.

Evaluation of the electrodes prepared in Examples 18–34 is conducted in accordance with the procedure of Example 1 and indicates only minor loss of the primary phase matrix metal and particulate material trapped in said matrix.

While this invention has been described with reference to certain specific embodiments, it will be recognized by those skilled in the art that many variations are possible without departing from the scope and state of the invention, and it will be understood that it is intended to cover all changes and modifications of the invention disclosed herein for the purpose of illustration which do not constitute departures from the spirit and scope of the invention.

What is claimed is:

1. An electrode for use in electrochemical reactions comprising (1) an electrically conducting, electrocatalytically inert metal substrate or a non-metallic substrate having an electrically conducting, electrocatalytically inert metallic surface thereon and (2) an electrocatalytically active coating consisting of:

A) a porous, dendritic, heterogeneous, electrocatalytically active primary phase coating on said substrate having a substantial internal surface area comprising a platinum group metal matrix in admixture with a particulate material, B) a secondary phase intermediate coating comprising a water insoluble, adhesion promoting polymer having a nitrogen-containing functional group and an electroless metal plating catalyst; and C) an outer phase metal reinforcement coating comprising a transition metal or alloy thereof.

2. The electrode of claim 1 wherein said electrically conducting, electrocatalytically inert, metallic substrate or said metallic coating on said non-metallic substrate comprises a metal selected from the group consisting of iron, steel, nickel, stainless steel, copper, cobalt, silver, and alloys thereof.

3. The electrode of claim 2

A) wherein said porous, primary phase coating is formed on a nickel substrate by a non-electrolytic reductive deposition method, an electrodeposition method, a thermal spraying method, or a sintering method, and said primary phase coating comprises a platinum group metal in admixture with a metal oxide particulate material and B) wherein said reinforcement coating comprises a transition metal or alloy selected from the group consisting of nickel, cobalt, copper, and alloys thereof with phosphorus, boron, or sulphur.

4. The electrode of claim 3 wherein said catalyst is a platinum group metal, said adhesion promoting polymer contains a nitrogen-containing functional group in which the nitrogen has a tone pair of electrons which can form a coordination complex with a metal ion or a compound of a metal, said metal oxide particulate material is selected from the group consisting of the oxides of platinum group metals, rhenium, technetium, molybdenum, chromium, niobium, tungsten, tantalum, manganese, and lead, and said reinforcement phase comprises a nickel-phosphorous alloy.

5. The electrode of claim 4 wherein said porous, dendritic, primary phase coating is applied by a non-electrolytic deposition process from a fluid medium comprising an aqueous solvent in which said platinum group metal is present as a soluble compound selected from the group consisting of platinum group metal-halides, -nitrates, -nitrites, -sulfates, and -phosphates, said metal oxide particulate material is selected from the oxides of ruthenium, iridium, osmium, rhenium, platinum, palladium, rhodium, technetium, and mixtures thereof, and said oxide has an average particle size of up to 20 microns, said electroless metal plating catalyst is palladium, and said primary phase coating is applied at a coating weight of 400 to 1500 ug/cm$^2$, calculated as the metal in the atomic form.

6. The electrode of claim 5 for use in a chlor-alkali electrolytic cell wherein said water insoluble polymer is selected from the group consisting of polymers and copolymers of poly(4-vinylpyridine), poly(2-vinylpyridine), poly (aminostyrene), poly(vinylcarbazole), poly(acrylonitrile), poly(methacrylonitrile), and poly(allylamine), and said reinforcement coating has a thickness of about 0.01 to about 3 microns and a coating weight of about 200 μg/cm$^2$ to about 10 mg/cm$^2$.

* * * * *